United States Patent [19]

Bayliss

[11] 4,323,106

[45] Apr. 6, 1982

[54] KNOCK-OUT SYSTEMS FOR FOUNDRIES

[75] Inventor: Colin R. Bayliss, Redditch, England

[73] Assignee: BCIRA, Birmingham, England

[21] Appl. No.: 130,719

[22] Filed: Mar. 17, 1980

[30] Foreign Application Priority Data

Mar. 27, 1979 [GB] United Kingdom ..... 10556/79

[51] Int. Cl.[3] ..... B22D 29/00

[52] U.S. Cl. ..... 164/260; 164/401; 294/81 R

[58] Field of Search ..... 164/401, 131, 404, 260, 164/261; 294/81 R, 103 R, 87 R, 161; 403/338, DIG. 9; 249/219 R; 269/152

[56] References Cited

U.S. PATENT DOCUMENTS

| | | | |
|---|---|---|---|
| Re. 16,470 | 11/1926 | Stoney et al. | 164/261 X |
| 307,439 | 11/1884 | Corbett | 269/152 |
| 1,526,765 | 2/1925 | Anderson | 164/401 |
| 1,734,176 | 11/1929 | McCabe | 164/404 X |
| 1,736,366 | 11/1929 | Ramsden | 164/401 |
| 3,154,338 | 10/1964 | Leach | 294/81 R X |
| 3,262,595 | 7/1966 | Seip, Jr. et al. | 294/103 R X |
| 4,185,681 | 1/1980 | Church et al. | 164/131 X |

*Primary Examiner*—Robert D. Baldwin
*Assistant Examiner*—J. Reed Batten, Jr.
*Attorney, Agent, or Firm*—Scrivener, Clarke, Scrivener and Johnson

[57] ABSTRACT

An apparatus for use in a so-called knock-out or shake-out system for foundries comprises a beam which may be resiliently suspended by a stirrup and bellows. A pair of tubular frames depend from the ends of the beam and a pair of rectangular clamp frames are vertically slidable in the tubular frames. A mold box comprising a pair of box-frames and containing a metal casting in a sand mold is located between the two pairs of frames. Two sets of bellows one associated with each clamp frame are inflated to raise the clamp frames and clamp the box between the lower crosspiece of these frames and some other part of the structure such as the lower cross-piece of the tubular frames. The mold is vibrated by vibrators so that the sand and casting are shaken out of the box.

3 Claims, 2 Drawing Figures

KNOCK-OUT SYSTEMS FOR FOUNDRIES

This invention relates to so-called knock-out or shake-out systems for foundries by which a metal casting is displaced from a box containing a particulate mold such as a sand mold.

Sand molds for castings are generally contained in metal boxes, usually in a pair of open rectangular box-frames containing the cope and the drag respectively. A common way of removing the solidified castings from the molds is to place the boxes containing the molds on a vibrating grid, which shakes the sand loose and allows it to fall through the grid.

The noise level in such a system is very high and comes mainly from two sources, namely the impact between the boxes and the grid, and the impact between adjacent boxes. The second source can be eliminated by keeping the boxes apart, but not the first.

This invention arises from attempts to devise a system in which the noise level is significantly reduced, without reducing the rate of handling the molds, and possibly even significantly increasing the rate of handling the molds.

According to the invention, an apparatus for displacing a metal casting from a box containing a particulate molds, comprises a structure adapted to be suspended in the air from above and to engage and support the box, and means to vibrate the structure so as to shake the particulate material from around the casting and thereby displace the casting from the box.

In most cases the particulate material will be sand, although other refractory materials could be used.

The structure may be vibrated by means of one or more vibrators of the type which employ pneumatically operated pistons or, particularly when heavy loads are to be handled, a vibrator of the rotary electric type may be used. The vibrator or vibrators may be mounted in any suitable position on the structure.

The structure preferably includes at least one clamp which is adapted to grip the box during vibration so that there is less risk of noise being generated by relative movement between the box and the structure.

Preferably the structure includes a pair of clamps adapted to grip opposite ends of the box and the clamps are preferably capable of being swung apart to facilitate their engagement and disengagement with the box.

When the box comprises a number of box-frames, the clamp or clamps are preferably adapted to grip the box such that the box-frames are substantially incapable of relative movement during vibration, so as to eliminate this possible source of noise.

In a preferred arrangement, the structure comprises a beam and a pair of frames one depending from each end of the beam, each frame being associated with a device for raising the frame relative to the beam so as to clamp part of the box between part of the frame and some other part of the structure. The box may be clamped by means of one or more suitable projections such as handles, studs, trunnions or flanges.

Preferably the frames extend over the top of the beam and the devices for raising the frames are mounted on the beam and operate by exerting an upward force on the frames.

The best kind of devices for raising the frames are those which are fluid operated, either by liquid or gas. Pneumatic bellows are especially preferred because they are relatively cheap, they have no moving parts which may wear or vibrate and they have a relatively small closed height. They also have the advantage that they are completely sealed and therefore do not suffer any ingress of sand or dirt.

The vibrations produced during operation of the apparatus may be isolated from the lifting gear by adapting the structure to be resiliently suspended in the air, for example by the use of springs or a further set of pneumatic bellows.

In an especially preferred embodiment of the invention, an apparatus for displacing a metal casting from a box containing a particulate mold, comprises a beam adapted to be resiliently suspended in the air, a frame depending from each end of the beam, and each frame being associated with a device which is adapted to lift the frame relative to the beam such that, when the box is located between the frames and beneath the beam, part of the box can be clamped between part of the frame and some other part of the apparatus so that the box can then be lifted into the air by the apparatus, and the apparatus further includes means to vibrate the box so as to shake the particulate material from around the casting whilst the box is suspended in the air and thereby displace the casting from the box.

The frames may take various forms depending to some extent on the load which is to be lifted. In one arrangement the frames may each comprise a generally U-shaped member slidable in a pair of tubes which depend from the beam, and the tubes are preferably joined by a cross-member such that part of the box can be clamped between the cross-piece of the U-shaped member and the cross-member.

Preferably the frames can be moved along the beam so as to adjust the distance between the frames to accommodate boxes of different sizes.

The box may be clamped between the lower part of each frame and a projection on the underside of the beam or even the beam itself. This arrangement is particularly good where heavy loads are to be handled and the structure therefore needs to be relatively rigid.

The invention is described below, by way of example only, with reference to the accompanying diagrammatic drawings, in which.

Figure 1:
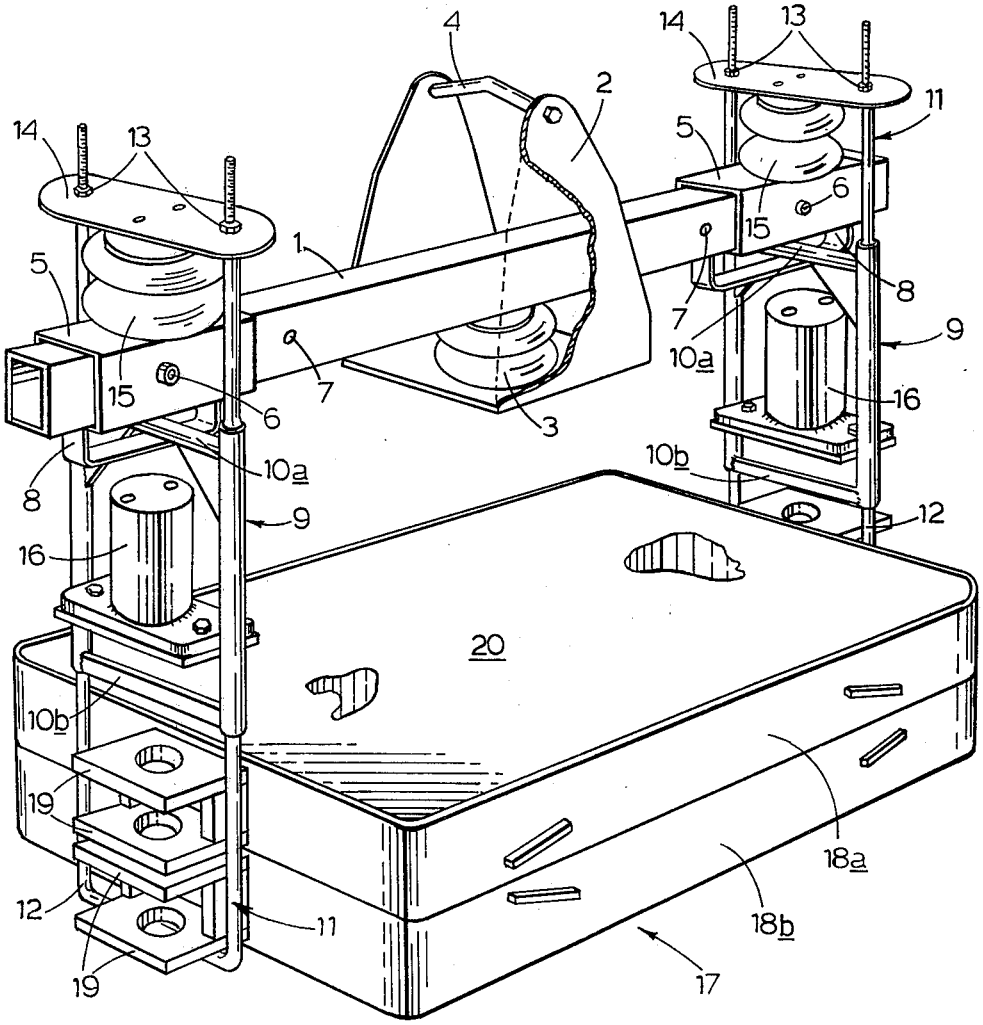
FIG. 1 is an isometric view of one embodiment of the apparatus.

In the apparatus shown in FIG. 1, a horizontal beam 1 of box-girder construction is supported at its mid-length by a stirrup 2 which embraces the beam without touching it. The beam rests on a set of air-filled bellows 3 which are located between the beam and the cross-piece of the stirrup 2. The upper ends of the arms of stirrup 2 are joined together by a cross-bar 4 for engagement by lifting gear, not shown, by which the apparatus may be suspended clear of its surroundings in use. The lifting gear could be an overhead gantry or a balancer-type work handler.

A pair of sleeves 5 are slidably carried one on each end of the beam 1 and these sleeves are fixed in position on the beam by bolts 6. A number of bolt-holes 7 are formed in the beam to allow the sleeves to be fixed in various positions. Each sleeve 5 carries on its underside a longitudinally extending strap 8. A rectangular steel frame 9 is suspended from each strap 8 by one of its shorter sides 10*a* which rests on the strap. The longer sides of the frame 9, which extend vertically, are hollow and slidably guide a rectangular clamp frame 11. This clamp frame 11 comprises a U-shaped rod 12, the arms of which extend above the beam 1 and are screw-threaded at their upper ends to receive nuts 13 for securing a plate 14 which forms the upper cross-piece of the clamp frame 11. A further set of air-filled bellows 15 are located between the plate 14 and the sleeve 5 to support the clamp frame 11.

Each frame 9 carries a pneumatic vibrator 16 of the type which employs reciprocable and cushioned pistons, and the vibrators are mounted so as to produce vibrations mostly in a vertical direction.

In use, the apparatus is moved into position above a mold box 17 using the lifting gear. The mold box 17 comprises a pair of box-frames 18*a*, 18*b*, each box-frame having a pair of handles 19 at each end. The box contains a metal casting surrounded by sand 20 which it is desired to remove from the box. The clamp frames 11 are then manually swung apart and the apparatus is lowered until the cross-piece of the U-shaped rods 12 can be swung beneath the handles. When this has been done, the bellows 15 are inflated by compressed air so that the clamp frames 11 slide upwards within the tubular legs of frames 9 until the handles 19 are firmly clamped between the cross-piece of the U-shaped rods 12 and the lower cross-piece 10*b* of the frames 9, thus firmly clamping together the box-frames 18*a* and 18*b*.

The apparatus is then positioned such that the box is suspended a few inches above a grid, not shown, and the vibrators 16 are switched on to vibrate the whole apparatus, including the mold box, to shake out of the box the sand and the casting. The bellows 3 substantially prevent the vibrations from being transmitted to the lifting gear.

The length of time taken to shake the casting out of the mold box is no greater with this system than with previous knock-out or shake-out systems, and the time may even be reduced in some cases due to more efficient shake-out.

When most of the sand has been shaken from the box and has fallen through the grid, and the casting has fallen onto the grid, the vibrators are switched off and the bellows 15 are deflated to allow the clamp frames 11 to be swung clear of the box. The cycle may then be repeated using a fresh box.

When a box need only be raised a relatively small distance the clamping action may impart sufficient lift to make the use of lifting gear unnecessary.

Mold boxes of different sizes may be accommodated by removing the bolts 6 and adjusting the position of the sleeves 5 on the beam 1 to give the required spacing between clamp frames 11. Mold boxes of different depths, and therefore having wider handle spacing, may be accommodated by adjustment of the position of the plate 14 on the threaded ends of the rod 12 by means of nuts 13.

In an evaluation under typical foundry conditions, the sound level produced by operation of this apparatus was found to be between 85 and 90 dB(A) as compared with previous knock-out or shake-out systems which often created sound levels well in excess of 100 dB(A). In a foundry environment this represents a significant noise reduction.

A single vibrator mounted at the mid-point of the beam 1 may be used in lieu of the vibrators 16.

The distance between the cross-pieces 10*b* and the cross-pieces of the U-shaped rods 12 may be adjusted by means of locking pins locatable in a series of holes in the ends of the rods, in lieu of the nuts and screw-threads.

Figure 2:
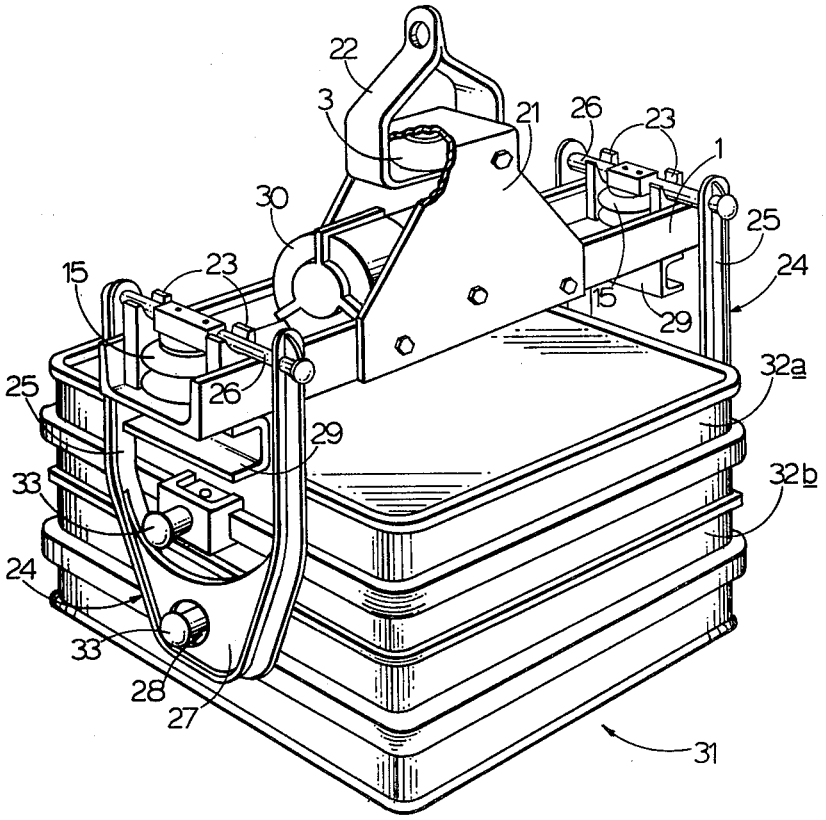
FIG. 2 is an isometric view of another embodiment.

The apparatus just described above is of light-weight construction and is intended for handling relatively light loads. The apparatus shown in FIG. 2 is constructed on the same principles as that of FIG. 1, but is intended for use with heavier loads. Parts which generally correspond to those of FIG. 1 have been given corresponding reference numerals.

The beam 1 is of U-shaped cross-section and a suspension member 21 of inverted-U cross-section is bolted to the beam 1 at its mid-length. A lifting stirrup 22 embraces the cross-piece of member 21 without touching it, and bellows 3 are located between the stirrup 22 and suspension member 21 to prevent vibrations being transmitted to the lifting gear. Each end of the beam 1 carries a pair of upwardly-extending forked supports 23 which support a pair of depending clamp frames 24.

Each clamp frame 24 comprises a generally U-shaped member 25 of which the upper ends of the arms are joined by a rod 26 which rests in supports 23. A web 27 connects the lower portions of the arms of member 25 and this web has a hole 28. A set of bellows 15 is located between each rod 26 and the beam 1. A pair of C-shaped bars 29 are attached to the underside of beam 1, one at each end of the beam and running transversely of the beam.

A high energy vibrator 30 of the rotary electric type is mounted on the beam 1 at about its mid length, beneath stirrup 22.

The apparatus is used in a similar manner to that of FIG. 1. The apparatus is positioned above a steel mold box 31, and the clamp frames 24 are swung apart, pivoting on the forked supports 23. The mold box 31 comprises a pair of box-frames 32*a*, 32*b*, each having a pair of studs 33 fixed one at each end of the box-frame, only one of each pair being shown in the drawings. The clamp frames 24 are swung together, and the studs 33 of the lower box-frame 32*b* are located in the holes 28. The bellows 15 are then inflated to lift the clamp frames 24 off their supports 23 and, when the bellows have been inflated sufficiently, the upper and lower box-frames become firmly clamped between the C-shaped bars 29 and the lower part of the clamp frames 24.

The box is then lifted into the air and vibrator 30 is energised to shake the sand and casting out of the box.

Note that since the vibrator is of a rotary type it imparts a considerable horizontal as well as a vertical vibratory motion to the apparatus.

I claim:

1. An apparatus for displacing a metal casting from a box formed of at least two relatively movable box frames positioned on top of each other and containing the casting in a mold of particulate material, said apparatus comprising in combination, suspension means by which the apparatus can be suspended from above, clamp means for clamping together the uppermost and lowermost of the box frames to render them incapable of relative movement, vibratory means for vibrating the box so as to shake the metal casting and particulate material out of the box, and resilient means for opposing transmission of vibrations to said suspension means, said clamp means comprising abutment means for the uppermost box frame, two clamp frames for engaging opposite ends of the lowermost box frame, and a respective lifting device for raising each of said clamp frames whereby the lowermost box frame can be lifted towards said abutment means to clamp together the box frames.

2. An apparatus according to claim 1, including a beam from which said clamp frames depend at opposite ends thereof, and an upper portion of each of said clamp frames that lies above said beam, said lifting devices being mounted between said beam and said upper portion of the respective clamp frame.

3. An apparatus for displacing a metal casting from a box formed of at least two relatively movable box frames positioned on top of each other and containing a casting in a mold of particulate material, comprising a beam, suspension means by which said beam can be suspended in the air, two pairs of parallel tubes one pair depending from each end of said beam, a respective cross-number joining each pair of tubes, a respective generally U-shaped member associated with each pair of tubes and comprising a cross-piece and a pair of parallel upstanding members slidable in said pair of tubes, a respective lifting device for raising each of said generally U-shaped members whereby the box frames can be clamped together between said cross-pieces and said cross-members to render the box frames incapable of relative movement, vibrating means for vibrating the box so as to shake the metal casting and the particulate material out of the box, and resilient means for opposing transmission of vibrations to said suspension means.

* * * * *